US005193747A

United States Patent [19]

Preussner

[11] Patent Number: 5,193,747

[45] Date of Patent: Mar. 16, 1993

[54] PROTECTIVE CAP FOR A FUEL INJECTION VALVE

[75] Inventor: Christian Preussner, Bamberg, Fed. Rep. of Germany

[73] Assignee: Robert Bosch GmbH, Stuttgart, Fed. Rep. of Germany

[21] Appl. No.: 671,901

[22] PCT Filed: Jul. 11, 1990

[86] PCT No.: PCT/DE90/00518

§ 371 Date: Mar. 19, 1991

§ 102(e) Date: Mar. 19, 1991

[87] PCT Pub. No.: WO91/02898

PCT Pub. Date: Mar. 7, 1991

[30] Foreign Application Priority Data

Aug. 19, 1989 [DE] Fed. Rep. of Germany ..... 3927390

[51] Int. Cl.[5] ..... F02M 61/18

[52] U.S. Cl. ..... 239/288.5; 239/533.12; 239/601

[58] Field of Search ..... 239/288.5, 533.2, 533.3, 239/533.12, 590.5, 601

[56] References Cited

U.S. PATENT DOCUMENTS

| | | | |
|---|---|---|---|
| 2,121,948 | 6/1938 | Borland | 239/601 X |
| 3,687,375 | 8/1972 | Griffiths | 239/601 X |
| 4,057,190 | 11/1977 | Kiwior et al. | 239/533.12 X |
| 4,266,729 | 5/1981 | Kulke et al. | 239/533.12 |
| 4,903,898 | 2/1990 | Kind | 239/533.12 |
| 4,925,111 | 5/1990 | Foertsch et al. | 239/533.12 |
| 5,109,824 | 5/1992 | Okamoto et al. | 239/601 X |

FOREIGN PATENT DOCUMENTS

| | | | |
|---|---|---|---|
| 3012416 | 10/1981 | Fed. Rep. of Germany . | |
| 3540660 | 5/1987 | Fed. Rep. of Germany . | |
| 143163 | 8/1983 | Japan | 239/601 |

*Primary Examiner*—Andres Kashnikow
*Assistant Examiner*—William Grant
*Attorney, Agent, or Firm*—Edwin E. Greigg; Ronald E. Greigg

[57] ABSTRACT

The protective cap for a fuel injection valve having a recess which extends radially outwards from a through flow passage, this recess being so small that it has a capillary effect on the fuel, so that when the internal combustion engine is stopped, the fuel constituents which boil at high temperatures are deposited on the radially outer edge of the recess, due the capillary action, and the injection orifice of the fuel injection valve remains free of deposits. The protective cap can be used for different types of fuel injection valves.

31 Claims, 1 Drawing Sheet

PROTECTIVE CAP FOR A FUEL INJECTION VALVE

LEVEL OF TECHNOLOGICAL DEVELOPMENT

The invention is based on a protective cap for a fuel injection valve. A fuel injection valve is already known (DE-OS 35 40 660) in which a protective cap is envisaged which shows a through passage in the base, downstream of an injection opening. The protective cap should prevent damage in the area of the injection opening or a possibly provided needle seat. It is furthermore intended, by means of the protective cap, to prevent particles from a the vicinity of the nozzle of a fuel injection valve which projects into the suction pipe, from being deposited in the area of the injection opening and resulting in a narrowing of the injection opening, which leads to the amount of injected fuel being undesirably reduced, and the fuel-air mixture supplied to the internal combustion engine thus becoming too lean. However, the use of this protective cap has the effect that, after the internal combustion engine has been stopped and the fuel injection valve has been closed, the fuel located in the through passage of the protective cap, usually present in film form, will then evaporate due to the now increased heating of the engine resulting from lack of cooling. However, as a rule, only the low-boiling point constituents of the fuel will evaporate, whilst those fuel constituents which boil only at higher temperatures remain in the through passage of the protective cap, and thus, during the operating time of the fuel injection valve, after a series of stopping and starting phases of the engine, lead to detrimental deposits in the area of at least one injection opening, so that the injection behavior deteriorates and the engine tends to run rough.

ADVANTAGES OF THE INVENTION

The fuel injection valve including a protective cap which is the subject of this invention has in contrast an advantage that the protective cap not only provides contact hazard protection, but also provides that even over prolonged operation of the engine, fuel deposits due to consecutive starting and stopping phases will not cause the amount of fuel metered by the fuel injection valve being undesirably reduced, thereby ensuring correct functioning of the engine.

From the measures listed herein further advantageous developments and improvements of the fuel injection valve mentioned are possible.

Of particular advantage is the design of the protective plastic cap, which provides for ease of manufacture.

SKETCH

The drawing shows, in simplified form, two examples of the embodiment of the invention, and these are more fully explained in the following description.

The drawings show in FIG. 1, a partial cross-sectional view of one example of a fuel injection valve designed in accordance with the invention;

in FIG. 2 a partial cross-sectional view of a second example of a fuel injection valve also designed in accordance with the invention;

and in FIG. 3 a section along lines 3—3 of FIG. 2.

DESCRIPTION OF THE EMBODIMENT SHOWN

Figure 1:
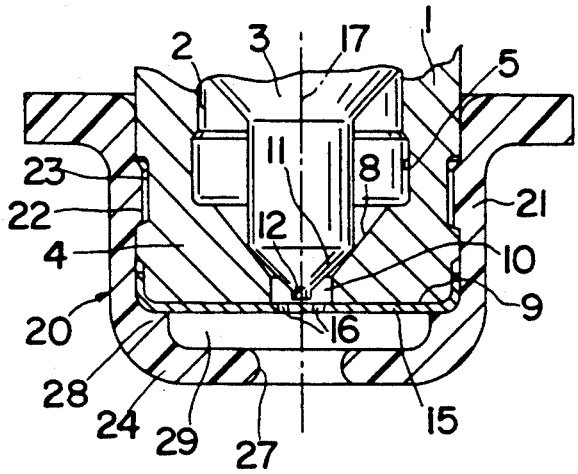

The fuel injection valve shown in partial view in FIG. 1 basically accords with a fuel injection valve, described in DE-OS 37 10 467, for a fuel injection system for a mixture-condensing, spark-ignition internal combustion engine, and serves to inject fuel into the induction manifold of the engine. A nozzle 1 is connected with a valve chamber, not shown; a valve needle 3 moves in a guide 2, into this nozzle. In the shown nozzle 1, the guide 2 terminates in a recess 5, where a conical valve seat 8 adjoins the recess in the direction of the fuel flow. A cylindrical through flow passage 10 in the nozzle 1 runs between the conical valve seat surface 8 and a nozzle front face 9. In the area of the valve seat surface 8 of nozzle 1, valve needle 3 passes into a conical sealing seat 11, which terminates in a cylindrical end portion 12. In the closed state of the fuel injection valve, the valve needle rests with its sealing seat 11 on the valve seat 8, whereas in the open state of the fuel injection valve, the sealing seat 11 is raised from the valve seat surface 8, and fuel can flow through the flow passage 10. A thin perforated dish plate 15, is sealed at the nozzle front face 9 by welding; in the area covered by the through flow passage 10, this dish plate has at least one injection orifice 16 which penetrates the dish plate and runs at an incline to the valve longitudinal axis 17, the incline, depending on the type of application, and may take such direction as to allow the fuel jets emitting from the individual injection orifices 16 to be directed either towards the valve longitudinal axis 17, or away from the valve longitudinal axis 17. The amount of fuel injected per unit of time, while the fuel injection valve is open, is determined by the cross-section area of the injection orifices 16. The opening of the fuel injection valve takes place electromagnetically in a manner well known in the art. The injection orifices 16 are arranged on the dish plate 15 in such a way that they go out from the annulus formed between the end portion 12 of the valve needle 3 and the side of the through flow passage 10, the cylindrical end portion 12 projects almost up to the dish plate 15 when the fuel injection valve is closed.

A cup-shaped protective cap 20 is pushed onto the nozzle end 4; this protective cap partially covers the nozzle 1 with a cylinder jacket 21 in an axial direction, and with a notch step 22 locks into a snap-ring groove 23 of the nozzle 1, for fixing the position of the protective cap 20. A base 24 of the protective cap 20 includes a through flow passage 27 concentric with the valve longitudinal axis 17, and the base extends in a radial direction over dish plate 15, contacting the dish plate 15 with a supporting section 28. Starting from section 28, base 24 extends radially inwards as far as the through flow passage 27 at an axial distance from dish plate 15, so that a ring-shaped recess 29 is formed there between the base 24 and the dish plate 15; the spacing of the recess being small compared to the diameter of the through flow passage 27. The protective cap 20 is prefereably made of a plastic material. The spacing of recess 29, i.e. the extension in the direction of the valve longitudinal axis 17, is very small, so that recess 29 has the form of an annular gap, which exerts such a large capillary effect on fuel in all positions of the fuel injection valve that the fuel in recess 29, due to its weight, does not flow away from the through flow passage 27. The recess 29, starting from through flow passage 27, can contract or expand by an increasing radial extension in an axial direction. If the internal combustion engine is now stopped, and thus also the fuel injection system, then the fuel injection valve will close and any fuel in recess 29 and the through flow passage 27 is partially vaporized due to the increased heating of the engine, whereby only the fuel constituents which vaporize at low temperatures will evaporate, whilst those constituents which vaporize at high temperatures are not sufficiently heated and move, by means of the capillary action of recess 29, radially outwards where they are deposited on the wall of section 28, so that through flow passage 27 and dish plate 15 remain free of fuel deposits in the area of the injection orifices 16.

Figure 2:
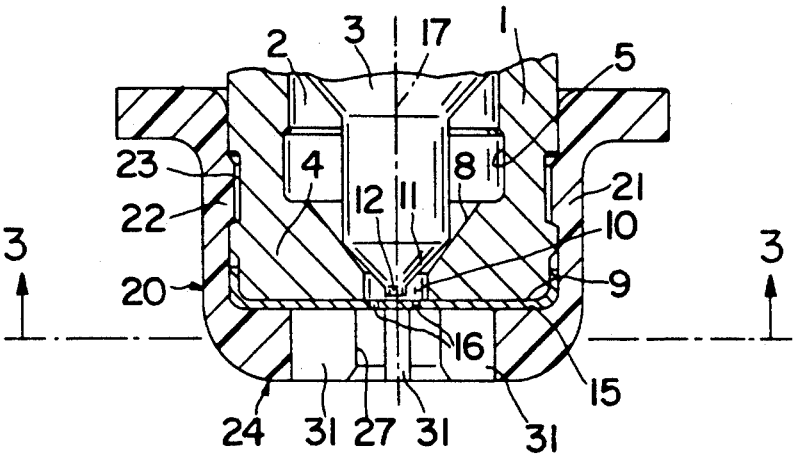
Figure 3:
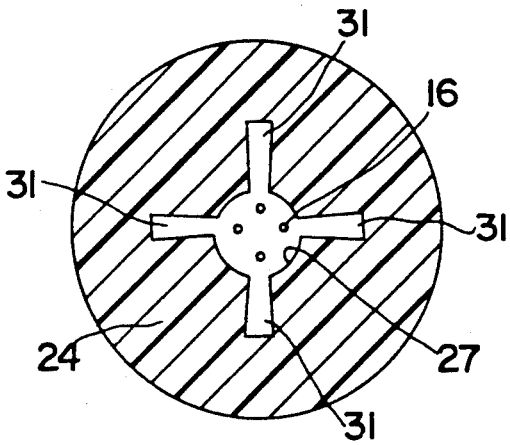

In the case of the second example of the fuel injection valve, shown in FIGS. 2 and 3, those parts which remain the same and function in the same way as the first example according to FIG. 1 are marked by the same reference numbers, so that to this extent the description of these parts in accordance with FIG. 1 also apply here. The protective cap 20 of the example according to FIG. 2 differs from the protective cap of the example according to FIG. 1 in that no axial distance is formed between base 24 and dish plate 15, but that starting from the through flow passage 27, at least one recess 31 is provided which penetrates base 24 in a radial direction. This recess is slot-shaped and extends in the direction towards the cylinder jacket 21. For example, there can be four recesses 31 which can be equidistant from one another circumferentially, as shown in FIG. 3, and the bore of these recesses measured in circumferential direction and having a capillary effect on the fuel in each position of the fuel injection valve, is small in comparison to the diameter of through flow orifice 27. Here, the recesses 31 can contract or expand with increasing radial extension towards the circumference. In FIG. 3, for example, four injection orifices 16 are shown, which have each been allocated one recess 31. The design is not, however, binding; an arrangement of more, or less than four, recesses is equally feasable, and it is also possible to have a different allocation to the injection orifices 16.

As has already been described in FIG. 1, when the internal combustion engine and the fuel injection system are shut down, the fuel injection valve will close and the fuel remaining in the through flow passage 27 and in the recesses 31 will travel radially outwards into the recesses 31; there, due to the capillary effect, at least those fuel constituents which boil at higher temperatures will remain, so that no fuel deposits arise at the injection openings 16 or in the through flow passage 27.

I claim:

1. A fuel injection valve including a fuel injection nozzle, a thin perforated plate covering an outlet end of said fuel injection nozzle, said thin perforated plate including at least one injection orifice (16), a cup-shaped protective cap attached to said fuel injection nozzle, said cup-shaped protective cap including a base which has a through flow passage open to said at least one injection orifice in said thin perforated plate, said base extending radially inwardly as far as the through flow passage, said flow passage having a wall upon which injected fuel is deposited, at least one recess (29, 31) is provided in said cup-shaped protective cap in an immediate vicinity of said at least one injection orifice (16) in said perforated plate, said recess having a capillary effect on the injected fuel deposited on said wall of said flow passage, said capillary effect being of a magnitude such that fuel does not flow away from the through flow passage due to its weight.

2. A fuel injection valve in accordance with claim 1, in which said at least one recess (29) is open to said through flow passage (27), and said at least one recess extends radially outwards and is covered by said base (24) of the protective cap (20).

3. A fuel injection valve in accordance with claim 2, in which at least one recess (29) is of ring-shaped design.

4. A fuel injection valve in accordance with claim 3, in which said at least one recess (29) starting from the through flow passage (27) can contract or expand with increasing radial extension in an axial direction.

5. A fuel injection valve in accordance with claim 1, in which said at least one recess (31) is open to said through flow passage (27), and said at least one recess extends radially outwards and penetrates the base (24) in an axial direction.

6. A fuel injection valve in accordance with claim 5, in which said at least one recess (31) is of a slot-shaped design.

7. A fuel injection valve in accordance with claim 6, in which said at least one recess (31) starting from the through flow passage (27) contracts or expands with increasing radial extension towards the circumference.

8. A fuel injection valve in accordance with claim 1, in which a spacing of said at least one recess (29, 31) in an axial direction is small compared to a diameter of the through flow passage (27) of the protective cap (20).

9. A fuel injection valve in accordance with claim 2, in which a spacing of said at least one recess (29, 31) in an axial direction is small compared to a diameter of the through flow passage (27) of the protective cap (20).

10. A fuel injection valve in accordance with claim 3, in which a spacing of said at least one recess (29, 31) in an axial direction is small compared to a diameter of the through flow passage (27) of the protective cap (20).

11. A fuel injection valve in accordance with claim 4, in which a spacing of said at least one recess (29, 31) in an axial direction is small compared to a diameter of the through flow passage (27) of the protective cap (20).

12. A fuel injection valve in accordance with claim 5, in which a spacing of said at least one recess (31) in a circumferential direction is small compared to a diameter of the through flow passage (27) of the protective cap (20).

13. A fuel injection valve in accordance with claim 6, in which a spacing of said at least one recess (31) in a circumferential direction is small compared to a diameter of the through flow passage (27) of the protective cap (20).

14. A fuel injection valve in accordance with claim 7, in which a spacing of said at least one recess (31) in a circumferential direction is small compared to a diameter of the through flow passage (27) of the protective cap (20).

15. A fuel injection valve in accordance with claim 1, in which the protective cap (20) is made of a plastic material.

16. A fuel injection valve in accordance with claim 2, in which the protective cap (20) is made of a plastic material.

17. A fuel injection valve in accordance with claim 3, in which the protective cap (20) is made of a plastic material.

18. A fuel injection valve in accordance with claim 4, in which the protective cap (20) is made of a plastic material.

19. A fuel injection valve in accordance with claim 5, in which the protective cap (20) is made of a plastic material.

20. A fuel injection valve in accordance with claim 6, in which the protective cap (20) is made of a plastic material.

21. A fuel injection valve in accordance with claim 7, in which the protective cap (20) is made of a plastic material.

22. A fuel injection valve in accordance with claim 8, in which the protective cap (20) is made of a plastic material.

23. A fuel injection valve including a fuel injection nozzle having a valve seat surface (8), at least one injection orifice (16), a cup-shaped protective cap attached to said fuel injection nozzle, said cup-shaped protective cap including a base which has a through flow passage open to said at least one injection orifice, said base extending radially inwardly as far as the through flow passage, said flow passage having a wall upon which injected fuel is deposited, at least one recess (29, 31) is provided in said cup-shaped protective cap in an immediate vicinity of said at least one injection orifice (16), said at least one recess having a capillary effect on the injected fuel deposited on said wall of said through flow passage, said capillary effect being of a magnitude such that fuel does not flow away from the through flow passage due to its weight.

24. A fuel injection valve in accordance with claim 23, in which said at least one recess (29) is open to the through flow passage (27), and said at least one recess extends radially outwards and is covered by the base (24) of the protective cap (20).

25. A fuel injection valve in accordance with claim 24, in which said at least one recess (29) is of ring-shaped design.

26. A fuel injection valve in accordance with claim 25, in which said at least one recess (29) starting from the through flow passage (27) can contract or expand with increasing radial extension in an axial direction.

27. A fuel injection valve in accordance with claim 23, in which said at least one recess (31) is open to the through flow passage (27), and said at least one recess extends radially outwards and penetrates the base (24) in an axial direction.

28. A fuel injection valve in accordance with claim 27, in which said at least one recess (31) is of a slot-shaped design.

29. A fuel injection valve in accordance with claim 28, in which said at least one recess (31) starting from the through flow passage (27) contracts or expands with increasing radial extension towards the circumference.

30. A fuel injection valve in accordance with claim 23, in which a bore of said at least one recess (29, 31) is small compared to a diameter of a through flow passage (27) of the protective cap (20).

31. A fuel injection valve in accordance with claim 23, in which the protective cap (20) is made of a plastic material.

* * * * *